US006108988A

United States Patent [19]

Nagelski et al.

[11] Patent Number: 6,108,988

[45] Date of Patent: Aug. 29, 2000

[54] SPIRAL CLIMB IN SURROUNDING ENCLOSURE

[75] Inventors: Keith C. Nagelski, Hunterville; Dustin C. Clark; Grant M. Strawcutter, both of Charlotte, all of N.C.

[73] Assignee: Soft Play, L.L.C., Charlotte, N.C.

[21] Appl. No.: 09/206,523

[22] Filed: Dec. 7, 1998

[51] Int. Cl.[7] ..... E04F 11/00

[52] U.S. Cl. ..... 52/187; 182/48; 446/476

[58] Field of Search ..... 52/187; 182/48; 446/476; 472/116, 136; 482/35

[56] References Cited

U.S. PATENT DOCUMENTS

| | | | |
|---|---|---|---|
| 277,156 | 5/1883 | Pardessus | 52/187 X |
| 309,619 | 12/1884 | Hamilton | 52/187 X |
| 318,086 | 5/1885 | Clarke | 52/187 X |
| 384,376 | 6/1888 | Mullin | 52/187 X |
| 506,238 | 10/1893 | Kirker | 52/187 |
| 3,013,640 | 12/1961 | Nehrbass | 52/187 |
| 3,667,176 | 6/1972 | MacKay . | |
| 3,894,614 | 7/1975 | Naka | 52/187 X |
| 4,338,751 | 7/1982 | Sanders | 52/187 |
| 4,660,335 | 4/1987 | Scholler . | |
| 5,088,248 | 2/1992 | Manna . | |

*Primary Examiner*—Robert Canfield

*Attorney, Agent, or Firm*—Polster, Lieder, Woodruff & Lucchesi, L.C.

[57] ABSTRACT

A modular spiral staircase within a surrounding enclosure for indoor playground equipment is disclosed. The modular spiral staircase includes individual stair treads arranged in a spiral pattern within the surrounding enclosure. The individual stair treads are vertically connected to one another and are circumferentially connected to the surrounding enclosure. Preferably, arcuate tread segments each having a plurality of integrally connected individual stair treads are provided. The individual stair treads are laterally offset from each other and are circumferentially arranged in a spiral pattern about an associated supporting central post. The surrounding enclosure includes enlarged spaced lower and upper openings that are aligned with the modular spiral staircase to facilitate entry and exit of a user.

10 Claims, 2 Drawing Sheets

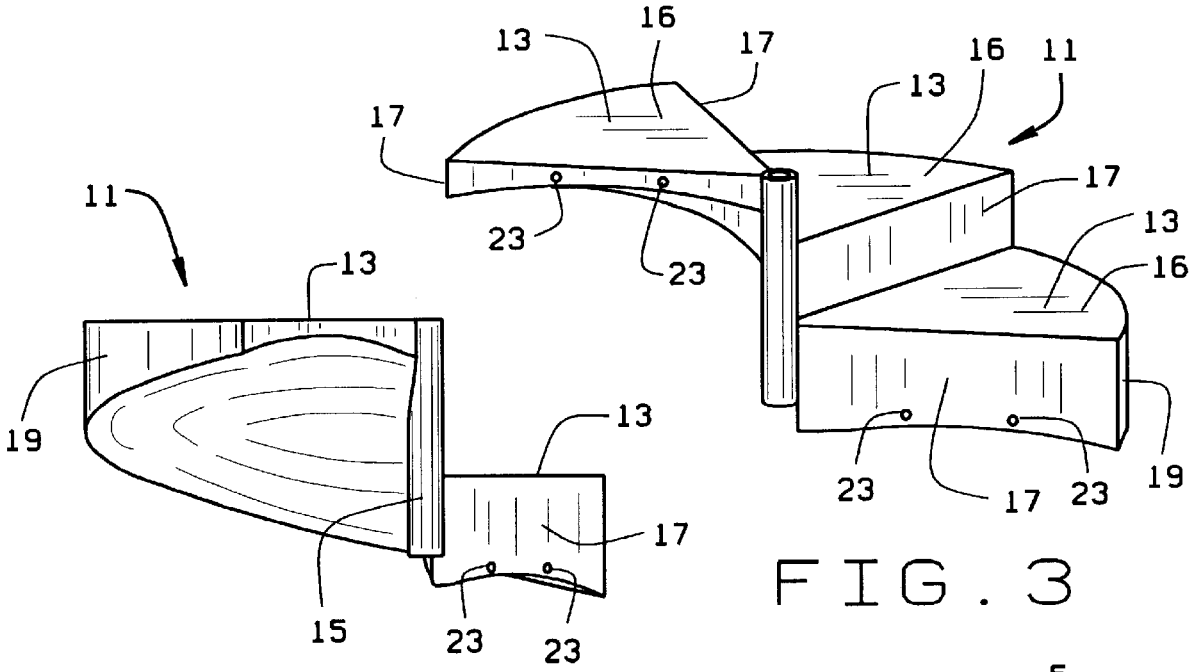
FIG. 3
FIG. 4
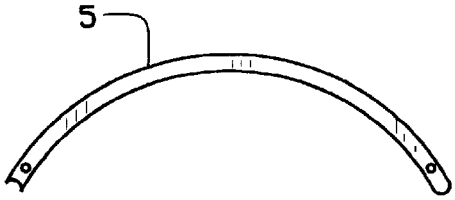
FIG. 6
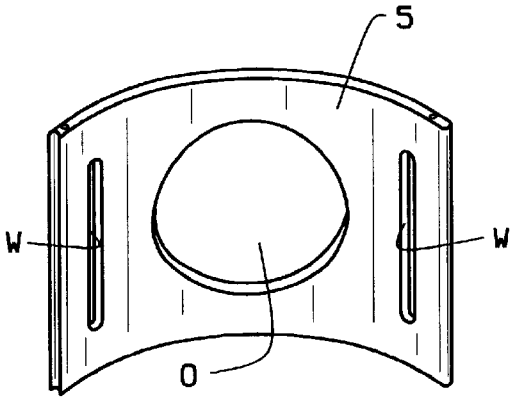
FIG. 5
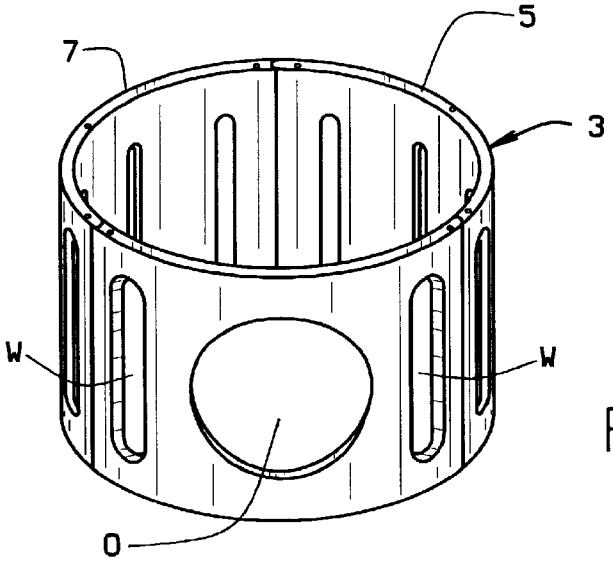
FIG. 7

SPIRAL CLIMB IN SURROUNDING ENCLOSURE

CROSS-REFERENCE TO RELATED APPLICATIONS

STATEMENT REGARDING FEDERALLY SPONSORED RESEARCH OR DEVELOPMENT

Not Applicable,

BACKGROUND OF THE INVENTION

The present invention relates to a modular spiral staircase contained within a surrounding enclosure generally for indoor playground equipment.

Indoor playground equipment typically provides a series of interconnected tubes and play structures to enable children to crawl and/or move through such tubes and structures for an exciting play experience. For physically challenged children, entry into and exit from such equipment is not so easily accomplished. This is due to the fact that the entry and exit openings of such tubes and structures has been limited to the size of such openings. With the passage of the American Disabilities Act, there has been interest in expanding various public structures, including playground equipment, for the use of physically challenged children, as well.

According to the present invention, entry into and exit from indoor playground equipment has been solved by the use of spiral steps in a surrounding enclosure with sufficiently large openings in the surrounding enclosure to permit access to and egress from indoor playground equipment by the physically challenged child.

Spiral staircases are well-known in the art. Typically, such spiral staircases include individual steps that extend laterally and radially from a central supporting post. Adjacent individual steps are attached through the associated central supporting post of such steps, with individual steps positioned to extend at any desired angular relationship until the required height of ascent/descent is achieved. Some examples of prior art of spiral staircases are shown in U.S. Pat. Nos. 3,667,176; 4,660,355 and 5,088,248.

However, spiral staircases in conjunction with surrounding enclosures have not been used in the prior art to facilitate entry into and exit from indoor playground equipment by the physically challenged child.

BRIEF SUMMARY OF THE INVENTION

Among the several objects of the present invention include:

The provision of a modular spiral staircase contained within a surrounding enclosure for indoor playground equipment;

The provision of the aforementioned modular spiral staircase and surrounding enclosure in which the surrounding enclosure includes upper and lower openings for entry and exit of a user;

The provision of the aforementioned modular spiral staircase and surrounding enclosure in which the entry and exit openings in the surrounding enclosure are enlarged to facilitate use by physically challenged individuals;

The provision of the aforementioned modular spiral staircase and surrounding enclosure in which individual stair treads arranged in a spiral pattern are vertically connected to one another and circumferentially connected to the surrounding enclosure;

The provision of the aforementioned modular spiral staircase and surrounding enclosure including integrally molded hollow cheese-wedge shaped stair treads arranged in a spiral pattern within the surrounding enclosure with each stair tread having an inner supporting central post which is connected to a corresponding central post of an adjacent stair tread, while also being connected to the surrounding enclosure;

The provision of the aforementioned modular spiral staircase and surrounding enclosure which is constructed to meet the requirements of the American Disabilities Act; and The provision of the aforementioned modular spiral staircase and surrounding enclosure which is efficiently and well constructed, manufactured in components for easy assembly; is durable and long-lasting; requires little maintenance and is otherwise welladapted for the purposes intended.

Briefly stated, the modular spiral staircase contained within a surrounding enclosure for indoor playground equipment includes individual stair treads arranged in a spiral pattern within the surrounding enclosure. The individual stair treads are vertically connected to one another while also being circumferentially connected to the surrounding enclosure.

Individual stair treads are part of an arcuate tread segment each having a plurality of individual stair treads radiating outwardly from a supporting central post, the supporting central post of arcuate tread segments being connected to one another. The individual stair treads include at least one side wall and end wall, the side wall of one adjacent stair tread being connected to a side wall of another adjacent stair tread while the end wall of at least some of the stair treads being connected to the surrounding enclosure. The plurality of individual stair treads are laterally offset from each other and circumferentially arranged about an associated supporting central post to enable the lower stair tread of an upper plurality of stair treads to be connected to an upper stair tread of a lower plurality of stair treads.

The stair treads are preferably integrally molded hollow cheese-wedge shaped stair treads arranged in a spiral pattern within the surrounding enclosure with each stair tread having an inner supporting central post that Is connected to a corresponding supporting central post of an adjacent stair tread and with each stair tread being connected to the surrounding enclosure.

The surrounding enclosure includes upper and lower openings in the surrounding enclosure that are aligned with the modular spiral staircase for entry and exit of a user. Desirably, the spaced upper and lower openings in the surrounding enclosure are enlarged for the use of a physically challenged child.

Preferably, the surrounding enclosure is cylindrically shaped and includes a plurality of windows and air openings to facilitate the view of the user. Preferably also, a roof overlies the surrounding enclosure.

These and other objects and advantages of the present invention will become apparent from the description that follows.

BRIEF DESCRIPTION OF THE SEVERAL VIEWS OF THE DRAWINGS

In the drawings.

FIG. 3 is an enlarged perspective view of an integrally connected series of arcuate tread segments arranged in a spiral pattern and forming individual stair treads within the surrounding enclosure;

FIG. 4 is an elevational view of the integrally connected series of arcuate segments shown in FIG. 3;

FIG. 5 is a bottom plan view of one segment of the surrounding enclosure;

FIG. 6 is an end elevational view of the one segment for the surrounding enclosure shown in FIG. 5; and FIG. 7 is a top plan view of the segment for the surrounding enclosure shown in FIG. 5.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
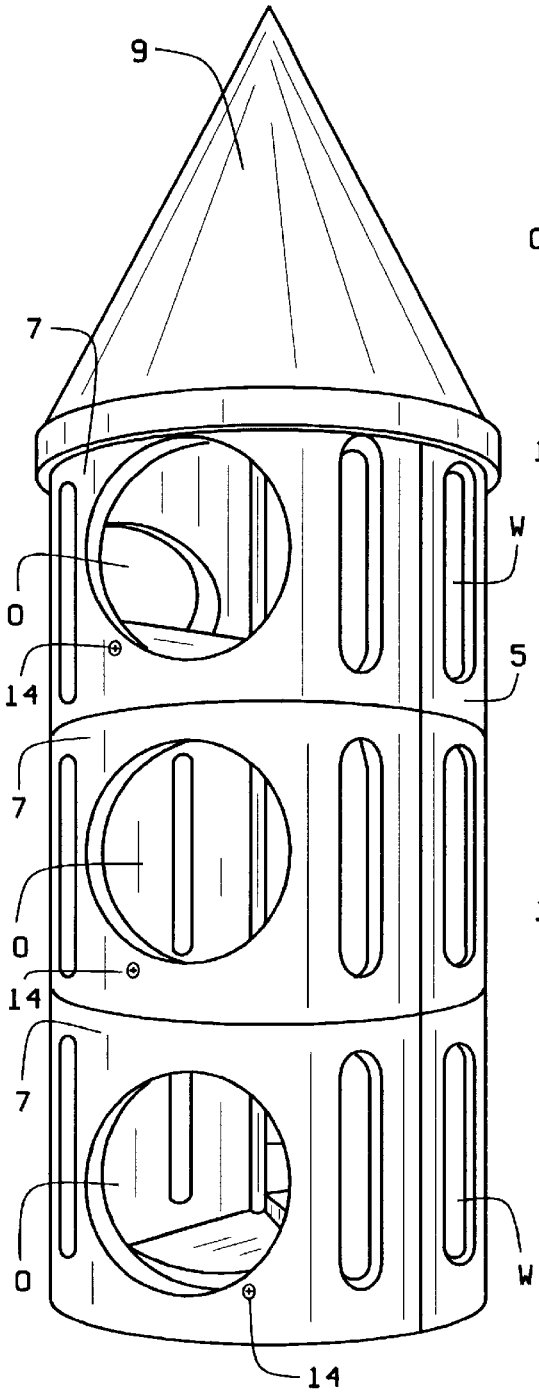
FIG. 1 is a perspective view of a modular spiral staircase contained within a surrounding enclosure for indoor playground equipment.
Figure 2:
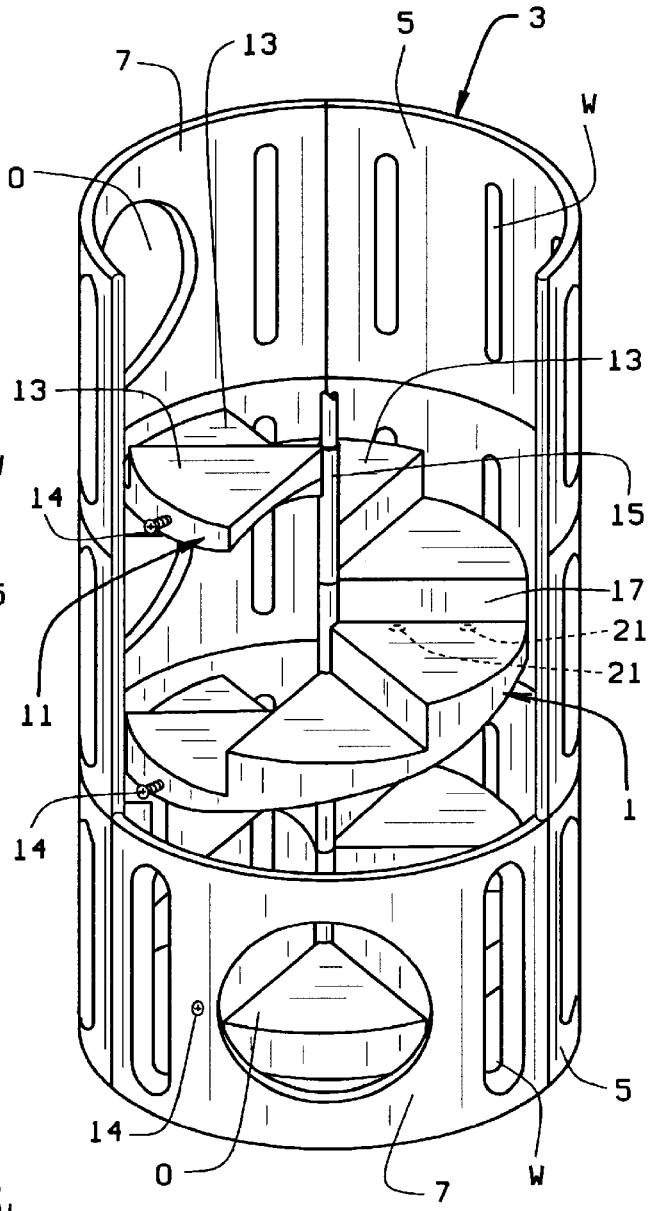
FIG. 2 is a perspective view of the modular spiral staircase contained within a surrounding enclosure in which part of the surrounding enclosure is removed to facilitate viewing of the modular spiral staircase in association relative to the surrounding enclosure.

The preferred embodiment of the modular spiral staircase 1 contained within a surrounding enclosure 3 is best illustrated in FIGS. 1–3 of the drawings. The surrounding enclosure 3 includes a series of cylindrically shaed panels 5, 7 arranged in a cylindrical pattern at each one of several vertical levels. The three cylindrical panels 5, 7 are thus arranged to not only form a cylindrical shape at one horizontal level, but also a series of cylindrically shaped vertical levels stacked upon each other, as shown in FIGS. 1–2 of the drawings. The surrounding enclosure 3 illustrated in FIGS. 1–2 shows three vertical levels of one-third cylindrical panels 5, 7 arranged in the above described manner to provide the vertically extending cylindrically shaped surrounding enclosure 3. The number of levels could be varied depending upon the configuration desired.

Some of the cylindrical panels 5 have window openings W while other cylindrical panels 7 have enlarged entry of exit openings O, in order to facilitate entry and exit from the surrounding enclosure 3. For design purposes, the surrounding enclosure 3 has a roof 9 that fits on top of the upper level of one-third cylindrically shaped panels 5, 7, as best shown in FIG. 1 of the drawings.

The spiral staircase 1 contained within the surrounding enclosure 3 is arranged to enable a user to enter an opening O at the lowermost level and exit an opening O at either an intermediate or uppermost level of the surrounding enclosure 3. As discussed previously, the spaced upper and lower openings O in the surrounding enclosure 3 are preferably enlarged to facilitate the entry into and exit from the surrounding enclosure by a physically challenged child. Once within this surrounding enclosure 3, the physically child can elect to return back to the entry opening or exit surrounding enclosure 3 from an intermediate or uppermost opening O into a series of interconnected tubes (not shown) which are interconnected to the surrounding enclosure 3 through intermediate and uppermost openings O, as may be desired.

Window openings W are also provided in the surrounding enclosure 3. the location of the openings O and W can vary depending on the configuration desired.

The modular spiral staircase 1 is arranged in a spiral pattern within the surrounding enclosure 3 and includes a series of integrally connected arcuate tread segments 11 each having a plurality of individuals stair treads 13 radiating outwardly from a supporting central post 15, as best seen in FIGS. 2–3 of the drawings. As illustrated in FIG. 3 of the drawings, each individual stair tread 13 includes an upper planar wall 16 side walls 17 and an end wall 19. A side wall 17 of one individual stair tread 13 being connected to a side wall 17 of to another adjacent stair tread 13, through fasteners 21, and holes 23 as shown in FIG. 2 as well as be in connected to the supporting central post 15, in order to vertically connect the individual stair treads 13 relative to one another. The end wall 19 of at least some of the stair treads 13 is connected to the surrounding enclosure 3 through suitable fasteners 14 as will be appreciated. In this way, the individual stair treads 13 are both vertically and circumferentially connected to one another relative to the surrounding enclosure 3. As best seen in FIG. 3, there are a plurality of integrally molded hollow cheese-wedged shaped stair treads that are arranged in a spiral pattern around the supporting central post. The supporting central post 15 of the plurality of stair treads 13 is connected to a corresponding supporting central post 15 of an adjacent plurality of stair treads 13, as best in FIG. 2 of the drawing, in order to provide the modular spiral staircase 1 within the surrounding enclosure 3.

FIGS. 3–4 illustrate enlarged views of the Modular spiral staircase 11, while FIGS. 5–6 illustrate serveral different views of one of the three cylindrically aligned panels forming the surrounding enclosure 3 that is shown in FIG. 7.

It will be appreciated that other variations in both the modular staircase 1 and surrounding enclosure 3 may be made without departing from the scope of the present invention.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A modular spiral staircase contained within a surrounding enclosure, comprising:

a plurality of arcuate tread segments radiating outwardly from a supporting central post; the supporting central post being a height generally corresponding to the height of the plurality of accurate tread segments to provide inner lateral and vertical support for the plurality of accurate tread segments;

the supporting central posts of adjacent individual stair treads being vertically connected to one another;

the plurality of arcuate tread segments defining individual stair treads each having an upper planar wall, side walls and a curvilinear depending outer end wall;

a sidewall of a lower tread segment in an upper plurality of arcuate tread segments being connected to a sidewall of an upper tread segment in a lower plurality of arcuate tread segments at a position spaced form the corresponding supporting central posts; and the curvilinear depending outer end wall of each arcuate tread segment being circumferentially engaged by and connected to a surrounding enclosure.

2. The modular spiral staircase as defined in claim 1 in which each of the plurality of arcuate tread segments are integrally connected to its associated supporting central post.

3. The modular spiral staircase as defined in claim 1 in which each arcuate tread segment includes vertically directed angularly extending side walls radiating outwardly from its associated central post and being connected to the upper planar wall and curvilinear depending outer end wall of each associated arcuate tread segment, at least one angularly extending side wall of adjacent arcuate tread segments being connected to one another.

4. The modular spiral staircase as defined in claim 1 in which the supporting central posts of adjacent arcuate tread segments are at least partially telescopically mounted with respect to one another.

5. The modular spiral staircase as defined in claim 1 in which there are a plurality of individual stair treads connected to one supporting post and are spirally arranged with respect to one another.

6. The modular spiral staircase as defined in claim 1 in which the surrounding enclosure is cylindrically shaped.

7. The modular spiral staircase as defined in claim 4 in which the surrounding enclosure includes a plurality of windows and air openings.

8. The modular spiral staircase as defined in claim 5 including a roof overlying the surrounding enclosure.

9. The modular spiral staircase as defined in claim 6 including spaced lower and upper openings in the surrounding enclosure aligned with the modular spiral staircase for entry and exit of a user.

10. The modular spiral staircase as defined in claim 9 in which the spaced lower and upper openings in the surrounding enclosure are enlarged to facilitate entry and exit of a user.

* * * * *

UNITED STATES PATENT AND TRADEMARK OFFICE

CERTIFICATE OF CORRECTION

PATENT NO. : 6,108,988
DATED : August 29, 2000
INVENTOR(S) : Keith C. Nagelski et al.

It is certified that error appears in the above-identified patent and that said Letters Patent is hereby corrected as shown below:

Column 4,
Line 58, after wall, it reads “side walls”, it should read -- a side wall --;
Line 60, the first word reads “a”, it should read -- the --;
Line 61, after connected to, it reads “a”, it should read -- the --.

Signed and Sealed this

Fifteenth Day of October, 2002

*Attest:*

*Attesting Officer*

JAMES E. ROGAN
*Director of the United States Patent and Trademark Office*